United States Patent [19]

Krasser et al.

[11] 4,329,669

[45] May 11, 1982

[54] CIRCUIT BREAKER WITH AUXILIARY TRIPPING UNIT

[75] Inventors: Fritz Krasser; Oswald Onderka, both of Altdorf, Fed. Rep. of Germany

[73] Assignee: Ellenberger & Poensgen GmbH, Altdorf, Fed. Rep. of Germany

[21] Appl. No.: 168,340

[22] Filed: Jul. 11, 1980

[30] Foreign Application Priority Data

Jul. 13, 1979 [DE] Fed. Rep. of Germany ..... 2928277

[51] Int. Cl.[3] ..... H01H 83/00; H01H 73/48

[52] U.S. Cl. ..... 335/20; 335/35; 337/2

[58] Field of Search ..... 337/2, 3, 60; 335/35, 335/23, 20, 155

[56] References Cited

U.S. PATENT DOCUMENTS 4,167,720 9/1979 Krasser ..... 337/60

4,206,430 6/1980 Rusch et al. ..... 335/35

*Primary Examiner*—Harold Broome

*Attorney, Agent, or Firm*—Spencer & Kaye

[57] ABSTRACT

A manually operated two-pole excess-current protective circuit breaker includes a bimetal control for a switching latch serving both contact bridges. In case of an excess current, the circuit breaker is tripped by a switching latch actuated by the bimetal by virtue of its heat-caused deformation. The circuit breaker unit is provided with a plug-in auxiliary tripping unit having a solenoid-actuated plunger extending into the circuit breaker housing. The plunger moves codirectionally with the working end of the bimetal and cooperates with the switching latch of the circuit breaker. The plunger may assume an actuating position and a withdrawn position dependent upon whether the solenoid is in an energized or a de-energized state and the auxiliary tripping unit may serve as a zero-voltage tripper or as an excess-current tripper dependent upon its structural design which determines the relationship of the plunger positions to the states of solenoid energization.

8 Claims, 9 Drawing Figures

CIRCUIT BREAKER WITH AUXILIARY TRIPPING UNIT

BACKGROUND OF THE INVENTION

This invention relates to a two-pole excess-current protective circuit breaker which is manually operated and which includes a bimetal control for a switching latch serving both contact bridges. In case of an excess current, the circuit breaker is tripped and, as long as the bimetal is in its deformed state, a manual resetting (circuit making) cannot be effected. A circuit breaker of this type is disclosed in U.S. Pat. No. 4,167,720.

SUMMARY OF THE INVENTION

It is an object of the invention to provide an improved circuit breaker of the above-outlined type, the versatility of which is expanded with simple means.

This object and others to become apparent as the specification progresses, are accomplished by the invention, according to which, briefly stated, the circuit breaker unit is provided with a plug-in auxiliary tripping unit having a solenoid-actuated plunger extending into the circuit breaker housing. The plunger moves codirectionally with the working end of the bimetal and cooperates with the switching latch of the circuit breaker. The plunger may assume an actuating position and a withdrawn position dependent upon whether the solenoid is in an energized or a de-energized state and the auxiliary tripping unit may serve as a zero-voltage tripper or as an excess-current tripper dependent upon its structural design which determines the relationship of the plunger positions to the states of solenoid energization.

The invention thus provides that—in addition to the bimetal-controlled excess-current cutoff which is present in any event—by simple insertion (plug-in) of an additional control unit into the circuit breaker unit, either a solenoid-controlled zero-voltage cutoff or a solenoid-controlled excess-current cutoff can be effected. The solenoid-controlled additional excess-current cutoff has the advantage of a faster cutoff response to a short circuit than in case of a bimetal control. The solenoid-controlled zero-voltage cutoff is of advantage when the circuit breaker is used for the control of apparatuses which should be de-energized not only in case of an excess current, but also in case of zero voltage. This is desirable, for example, in electric saws which, as a safety measure for preventing accidents, must not restart automatically if, following a power failure, the voltage is re-applied.

According to a further advantageous feature of the invention, the additional tripping unit can be manually attached in its operative position on the circuit breaker housing in a simple manner.

According to a further feature of the invention, by inserting the additional control unit on the housing of the circuit breaker, it is automatically connected (by effecting plug-in connections) with the current conductor of the circuit breaker unit without thereby causing changes in the logic of the electric components of the entire assembly formed of the additional control unit and the circuit breaker.

BRIEF DESCRIPTION OF THE DRAWING

FIG. 9 is a view similar to FIG. 7, showing the second preferred embodiment in an energized state (excess current).

DESCRIPTION OF THE PREFERRED EMBODIMENTS

Figure 1:
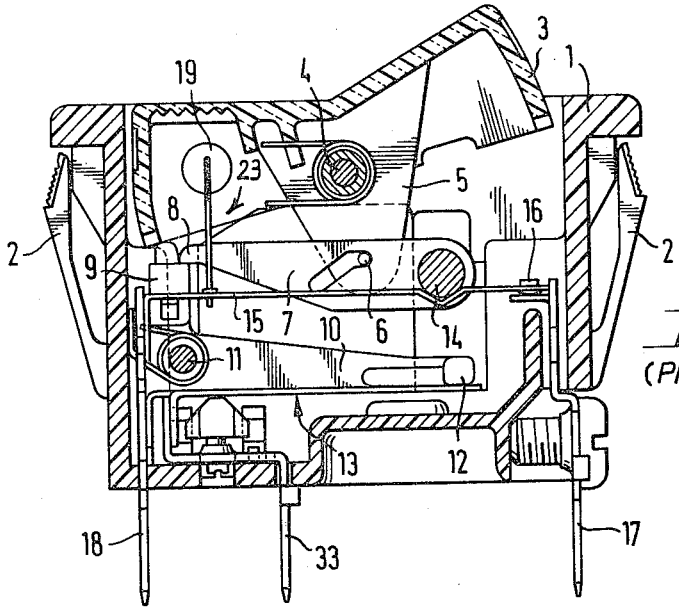
Fig. 1 (PRIOR ART)
FIG. 1 is a sectional view taken in the plane of movement of the individual components of a circuit breaker according to the prior art.

Turning now to FIG. 1, the known circuit breaker according to U.S. Pat. No. 4,167,720 includes a housing 1 which is made of synthetic material and which has integral resilient jaws 2 for securement in a front plate (not shown). A rocker button 3 is supported in the housing 1 for rotation about a shaft 4 and is arranged to actuate a pivotal switching lever 7 by means of an actuating pin 6 affixed to a lower arm 5 of the rocker button 3. The switching lever 7 which is supported at one end by a shaft 14, has at its free end a lug portion 8 which engages a vertically extending leg 9 of a two-arm tripping lever 10 which is pivotally supported about a shaft 11 extending perpendicularly to the drawing plane of FIG. 1. The free end of the longer, horizontal leg of the tripping lever 10 constitutes an abutment 12 for the movable end of a directly or indirectly heatable bimetal strip 13 which is generally of U shape lying on its side as viewed in FIG. 1.

The support shaft 14 of the switching lever 7 projects beyond both sides of the switching lever 7 in a direction perpendicular to the drawing plane of FIG. 1. The switching lever 7 is supported in the housing 1 by means of the shaft 14 in such a manner that the switching lever 7 is shiftable in the direction of a contact spring 15 in an approximately vertical direction (as viewed in FIG. 1) and is furthermore rotatable about the axis of the shaft 14. During transition into the on-position, the rocker button 3, via the switching lever 7 and the shaft 14, presses the contact spring 15 into the horizontal position shown in FIG. 1. In this position the contact spring 15 engages, with its contact terminus 16, the counter-contact connected with the terminal 17. With its other end the contact spring 15 is welded to the inner end of a terminal 18. There is further provided a small light bulb 19 through which current flows and which thus lights up when the contact spring 15 is in its closed, on-position.

The basic operation of the excess-current protective circuit breaker according to FIG. 1 is described in detail in the above-mentioned U.S. Pat. No. 4,167,720.

Figure 2:
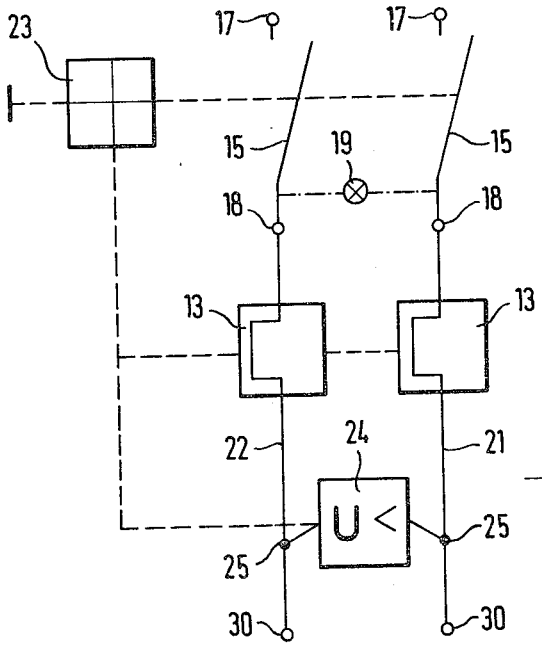
FIG. 2 is a circuit diagram of a first preferred embodiment of the invention.

According to the invention, the excess-current protective circuit breaker illustrated in FIG. 1 is combined with an auxiliary zero-voltage tripping unit 24 attachable to the housing 1 by simple plug-in. The operation of this combination will now be described in conjunction with the circuit diagram illustrated in FIG. 2.

The two-pole excess-current protective circuit breaker includes current conductors 21 and 22. With each current conductor 21 and 22 there is serially connected a respective thermal tripping device formed as a bimetal strip 13. It is feasible, however, to omit the bimetal strip from one of the current conductors, for example, from the current conductor 21. Further, with each current conductor 21 and 22 there is serially connected a contact spring 15 which serves to open and close the circuit. The bimetal strips 13 cooperate with the tripping lever 10 and thus actuate the switching latch generally indicated at 23 which is movable into the on or off position manually by means of the rocker button 3 and which is effective in the zone of the lug 8 of the switching lever 7. The contact springs 15 can be moved into or maintained in the on-position only when the switching latch 23 or the rocker button 3 is in the on-position. The zero-voltage tripping unit 24 is connected in parallel with the current circuit by means of two terminals 25 connected to the current conductors 21 and 22 respectively. Further, the bulb 19 is also connected in parallel with the current conductors 21 and 22.

Figure 3:
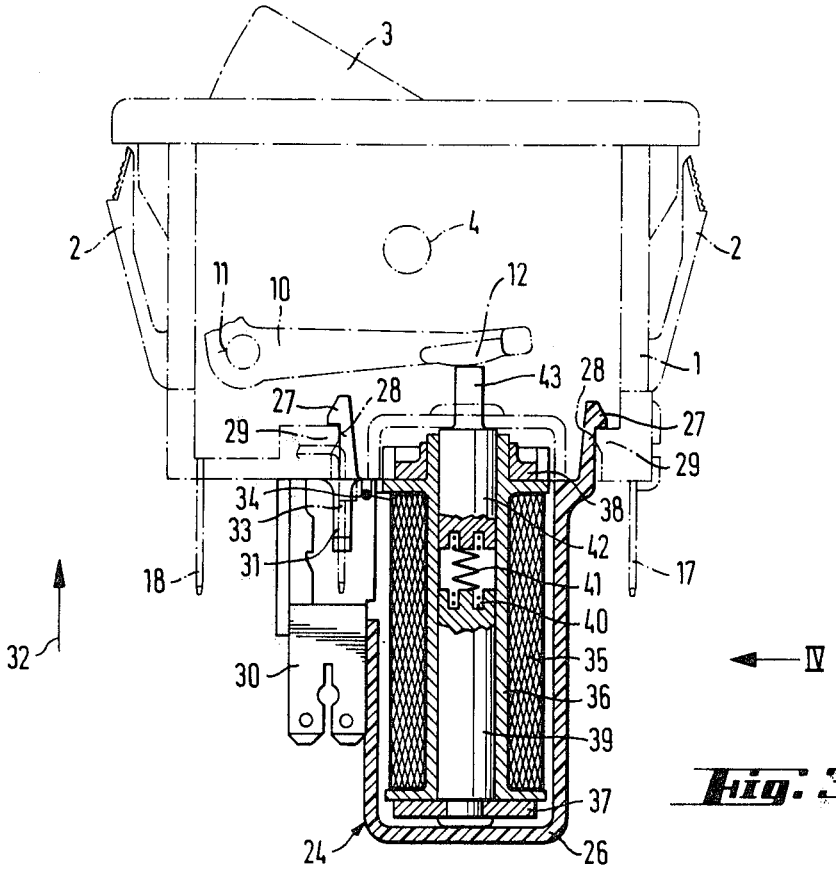
FIG. 3 is a sectional view of a zero-voltage tripping unit combined with a circuit breaker, according to the first preferred embodiment of the invention, shown in a de-energized state.

Also referring now to FIG. 3, the zero-voltage tripping unit 24 is in its off-position with regard to the excess-current circuit breaker. The switching latch 23 is open and no voltage difference is applied to the zero-voltage tripping unit.

The zero-voltage tripping unit 24 includes a plastic housing 26 having integral resilient hooks 27 which may be introduced into openings 28 provided in the circuit breaker housing 1 for engaging behind lugs 29 forming part of the housing 1. Terminal prongs 30 project vertically (as seen in FIG. 3) from that side of the unit 24 which is remote from the circuit breaker housing 1. That end of each prong 30 which is oriented towards the circuit breaker housing 1, has a socket 31 and is arranged at that end of the unit 24 which is oriented towards the circuit breaker housing 1. The sockets 31 cooperate with terminal prongs 33 of the current conductors 21 and 22. The terminal prongs 33 are oriented parallel to the vertical direction of insertion of the unit 24 indicated with the arrow 32 in FIG. 3. Thus, when the unit 24 is in place, the sockets 31 thereof receive the prongs 33 of the circuit breaker. The prongs 33 are thus hidden when the control device 24 is in place.

To the terminal posts of the prongs 30 there are soldered respective terminal leads 34 of a solenoid 35. The latter is wound on a coil form 36 which is surrounded by a magnet yoke 37. A yoke 38 closes the magnetic circuit at the outside. Within the coil form 36 there is disposed a core 39 which is firmly attached to the magnet yoke 37. The core 39 carries a short-circuiting ring 40 at one of its ends which is in engagement with one end of a spring 41. The other end of the spring 41 is in engagement with a plunger 42 having an external pin 43 pressing against the abutment end 12 of the tripping lever 10. It will become apparent upon a comparison between FIGS. 1 and 3 that both the bimetal strip 13 and the plunger pin 43 are operatively connected with the same leg (the horizontal leg, as viewed in the Figures) of the tripping lever 10. Thus, the vertical leg 9 of the tripping lever may be of very short, space-saving construction.

In the de-energized state of the solenoid 35, the spring 41 presses the plunger 42, with its upper pin 43, upwardly against the tripping lever 10 which, as a result, is urged to pivot counterclockwise about its shaft 11. This opens the switching latch 23. The interlock between the leg 9 of the tripping lever 10 and the lug 8 of the switching lever 7 is thus removed. Consequently, in a de-energized state of the solenoid 35 (that is, when there is no voltage difference at the terminals 30) the excess-current protective circuit breaker opens the circuit of the apparatus with which the circuit breaker is associated; furthermore, the circuit cannot be closed in this zero-voltage state.

Figure 5:
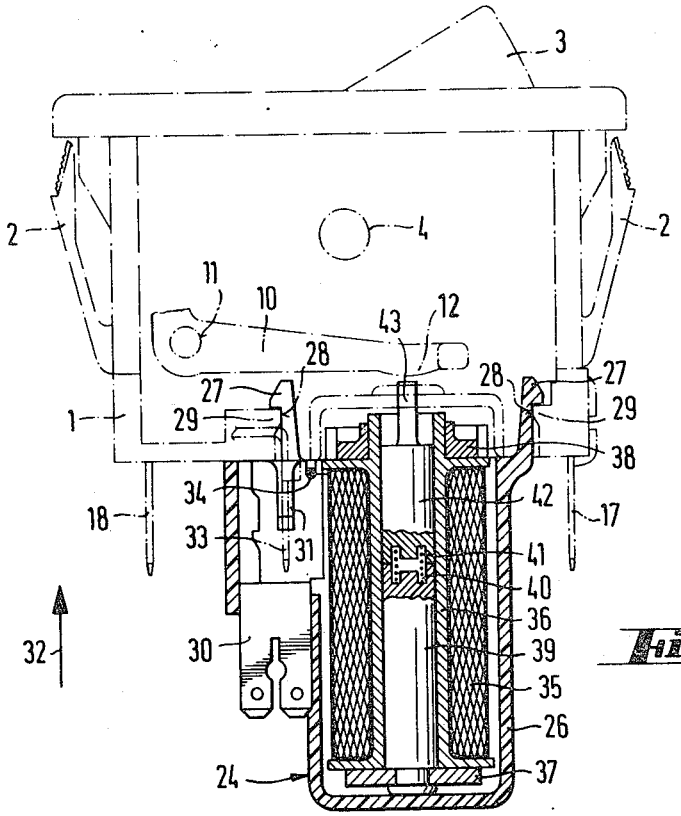
FIG. 5 is a view similar to FIG. 3, showing the first preferred embodiment in an energized state.

If, on the contrary, a voltage difference is applied to the solenoid 35, the plunger 42 is pulled inwardly (downwardly, as viewed in FIG. 3). The magnetic force of the solenoid 35 is so designed that it overcomes the opposing force of the spring 41. Consequently, the tripping lever 10 is pivoted about its shaft 11 clockwise, whereby the switching latch 23 closes and thus an interlock between the leg 9 of the tripping lever 10 and the lug 8 of the switching lever 7 is re-established. FIG. 5 illustrates the unit 24 in its energized state. As a result of such an energization, the electric apparatus with which the circuit breaker is associated can be switched on and its circuit remains closed as long as voltage difference is applied and no excess current appears or a manual switch-off is effected.

Figure 4:
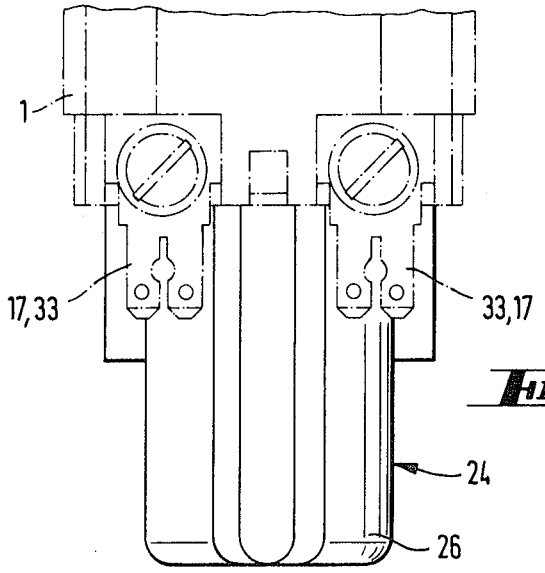
FIG. 4 is a side elevational view of the first preferred embodiment as seen in the direction of the arrow IV of FIG. 3.

FIG. 4 is an external view of the unit 24 as seen in the direction of the arrow IV of FIG. 3.

Figure 6:
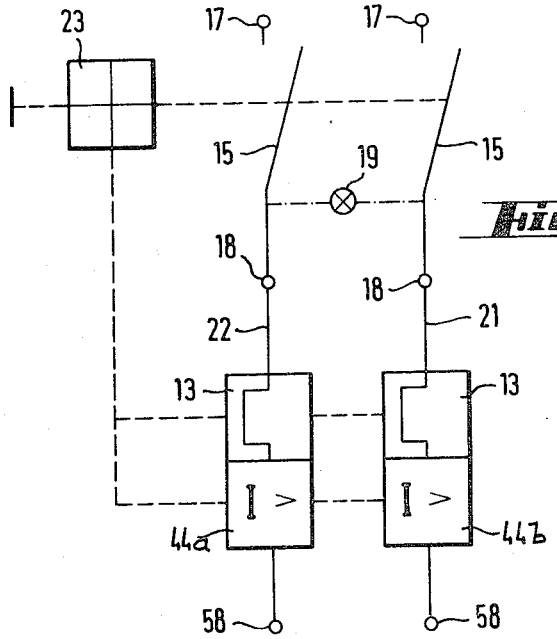
FIG. 6 is a circuit diagram of a second preferred embodiment of the invention.

Turning now to FIG. 6, there is illustrated a circuit diagram of the excess-current protective circuit breaker combined, according to the invention, with an auxiliary excess-current tripping unit, having magnetic trippers 44*a* and 44*b*. The diagram of FIG. 6 shows the assembly in its circuit-making state; the excess-current tripping unit is in a de-energized condition. Similarly to FIG. 2, the circuit of the assembly of FIG. 6 has two current conductors 21 and 22 as well as thermal trippers constituted by bimetal strips 13. With each current conductor 21, 22 and with the respective bimetal strip 13 there is serially connected a magnetic tripper 44*a*, 44*b*, respectively. The two magnetic trippers 44*a* and 44*b* as well as the two bimetal strips 13 cooperate with the switching latch 23 independently from one another.

Figure 7:
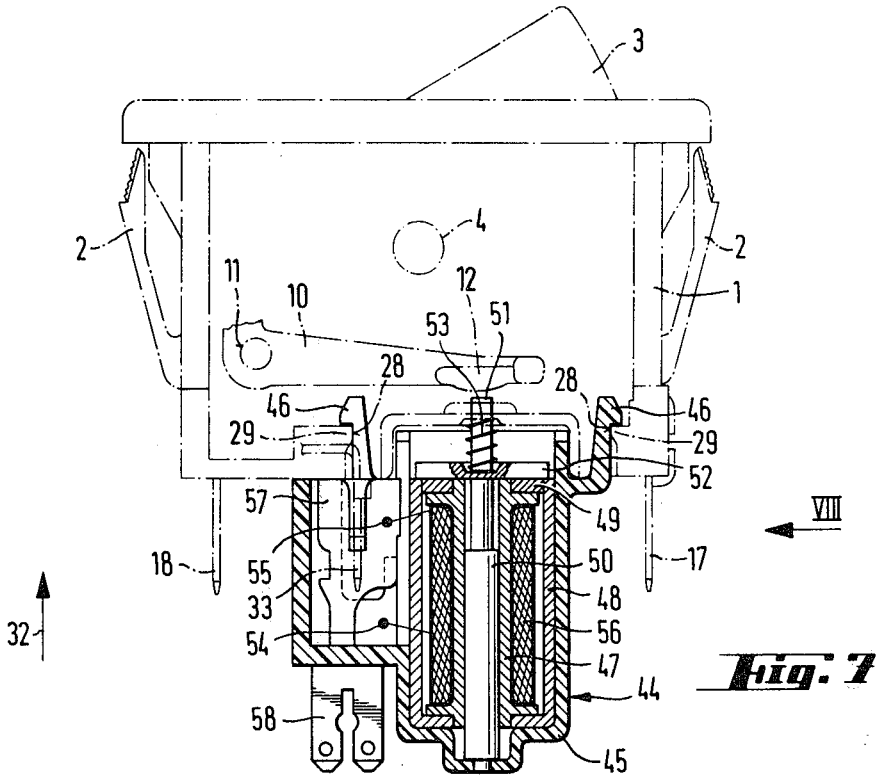
FIG. 7 is a sectional view of an excess-current tripping unit combined with a circuit breaker, according to the second preferred embodiment of the invention, shown in a de-energized state (no excess current).
Figure 8:
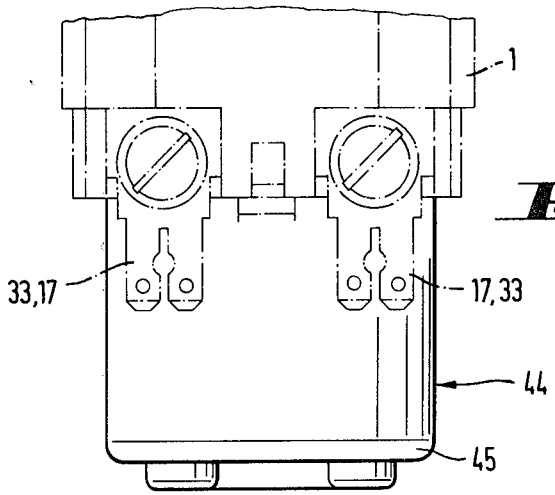
FIG. 8 is a side elevational view of the second preferred embodiment as seen in the direction of the arrow VIII of FIG. 7.
Figure 4:
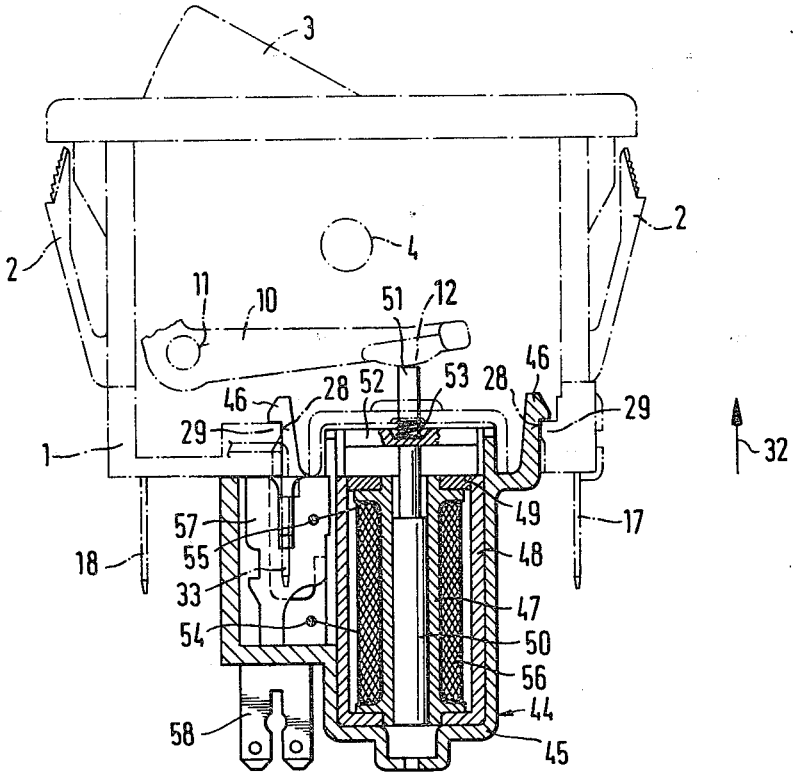

Turning to FIG. 7, the excess-current tripping unit 44 shown therein in a de-energized state, includes a plastic housing 45 which has integral resilient hooks 46 at its upper end for introduction into the openings 28 of the circuit breaker 1. The hooks 46 are adapted to engage behind lugs 29 forming part of the circuit breaker housing 1. FIG. 8 is an external view of the unit 44 as seen in the direction of the arrow VIII of FIG. 7.

In the housing 45 there are supported the two magnetic trippers 44*a*, 44*b*. Each tripper includes a coil form 47 (only one shown), on each there is wound a solenoid 56 and each is surrounded by a magnet yoke 48. The magnetic circuit is closed at the top by a yoke 49. Within each coil form 47 there is arranged an actuating plunger 50 movable in a direction parallel to the direction of insertion 32 of the unit 44. Each actuating plunger 50 has at its upper end a pin 51 which, in case the associated solenoid is energized by an excess current, presses against the abutment end 12 of the tripping lever 10 and effects an opening of the excess-current circuit breaker. FIG. 9 illustrates the unit 44 in its energized state. A compression spring 53 is in engagement with a spring seat 52 which, in turn, is supported on an extension of the pin 51 so that the height position of the spring seat 52 is changed as the actuating plunger 50 moves axially. The spring 53 engages, with its upper end, the circuit breaker housing 1 and serves to return the actuating plunger 50 into its lower, on-position when the solenoid 56 associated with the plunger 50 is no longer energized by an excess current.

The terminal leads 54 and 55 of the respective solenoid 56 are soldered to the terminals constituted by sockets 57 or prongs 58, respectively. The structure of the sockets 57 and prongs 58 corresponds to the components 31 and 30, respectively, described in connection with FIGS. 3 and 5.

The current is applied from the outside to the contact plugs 58; the current flows from the solenoid terminal 54 through the solenoid winding 56 to the solenoid terminal 55. The latter is soldered to the socket 57 which receives the prongs 33 of the circuit breaker.

The terminals formed by the prongs 30 and 58 may bear the same terminal designations as the prongs 33 of the circuit breaker so that a reversal of connections upon insertion of the unit 44 can be securely avoided.

It is to be noted that particularly in connection with the embodiment of FIGS. 7 and 9, by "energized" and "de-energized" state of the solenoid 56 there is meant the presence and, respectively, the absence of an excess-current flow through the windings of the solenoid 56. Thus, during normal operation of the electric circuit, although there is current flow through the solenoid 56, for the practical purposes relevant here, it will be in a "de-energized" state, thus, it will not overcome the force of the spring 53 urging the plunger 50 into its withdrawn (non-actuating) position. Such a spring force will be overcome by the magnetic flux only when excess current flows through the solenoid 56, thus, when the latter is in an "energized" state.

It will be understood that the above description of the present invention is susceptible to various modifications, changes and adaptations, and the same are intended to be comprehended within the meaning and range of equivalents of the appended claims.

What is claimed is:

1. In a two-pole excess-current protective circuit breaker including contacts having open and closed positions; manually engageable means operatively connected with said contacts for manually opening and closing the contacts; latching means having a normal position in which operation of said manually engageable means remains unimpeded; said latching means having a tripped position for opening and maintaining open said contacts irrespective of the position of said manually engageable means and bimetal means operatively connected with said latching means; said bimetal means having a normal state allowing said latching means to assume said normal position and a heat-caused deformed state in which said bimetal means displaces said latching means into, and maintains said latching means in said tripped position; said circuit breaker further including a first housing accommodating said movable contacts, said manually engageable means, said latching means and said bimetal means; the improvement comprising in combination:

(a) a pivotally supported tripping lever having first and second legs and forming part of said latching means; said bimetal means being operatively connected with said first leg;

(b) an electromagnetically operated auxiliary tripping unit including (1) a second housing;

(2) a solenoid accommodated in said second housing and having an energized state and a de-energized state;

(3) a plunger displaceably supported in said second housing and cooperating with said first leg of said tripping lever; said plunger having an advanced position in which the plunger pushes said tripping lever for setting said latching means into the tripping position; said plunger further having a withdrawn position in which the plunger allows said tripping lever to move for setting said latching means into the normal position; said solenoid, when in said energized state, moving said plunger into and maintaining said plunger in one of the plunger positions;

(4) a spring means accommodated in said second housing and being operatively connected to said plunger for moving said plunger into, and maintaining said plunger in the other of the plunger positions when said solenoid is in a de-energized state;

(c) mounting means for supporting said second housing on said first housing externally thereof;

(d) electric connecting means carried on said first and second housings; said electric connecting means being coupled to one another for electrically connecting said solenoid to the circuit breaker; and (e) means defining an opening in said first housing; said opening being in alignment with said latching means for providing passage of said plunger into said first housing for cooperation with said first leg of said tripping lever.

2. A circuit breaker as defined in claim 1, wherein said bimetal means has a working portion being in operative connection with said first leg of said tripping lever of said latching means; said working portion having a direction of motion when said bimetal means undergoes transition from one of its states to the other; further wherein said portion of said plunger has a path of motion codirectional with said direction of motion.

3. A circuit breaker as defined in claim 1, wherein said mounting means comprises a resilient hook formed on one of said housings, means defining an aperture and a lug in the other of said housings, whereby said resilient hook being introducible in said aperture for snapping behind said lug.

4. A circuit breaker as defined in claim 1, wherein said mounting means has components carried on said first and second housing and being interengageable with one another upon relatively moving said second housing towards said first housing in a direction of insertion.

5. A circuit breaker as defined in claim 4, wherein said electric connecting means includes (a) a first prong means electrically coupled to said bimetal means and projecting from said first housing in an orientation parallel to said direction of insertion in a zone of attachment of said second housing to said first housing;

(b) terminal socket means electrically coupled to respective terminals of said solenoid and being situated at a side of said second housing oriented towards said first housing; said socket means extending in an orientation parallel to said direction of insertion in said zone of attachment and in alignment with said first prong means, whereby a plug-in connection between said first prong means and said socket means is effected simultaneously with the attachment of said first housing on said second housing; and (c) second prong means supported by said second housing and projecting from a side of said second housing oriented away from said first housing; said second prong means being electrically coupled to said terminal socket means.

6. A circuit breaker as defined in claim 1, wherein each pole is associated with separate said contacts and said solenoid is connected in parallel with said separate contacts said plunger is arranged to move into said actuating position when said solenoid is de-energized and to move into said withdrawn position when said solenoid is energized.

7. A circuit breaker as defined in claim 1, wherein said solenoid is connected in series with said contacts; and further wherein said plunger is arranged to move into said actuating position when said solenoid is energized by a predetermined excess current and to move into said withdrawn position when no excess current flows through said solenoid.

8. A circuit breaker as defined in claim 7, wherein each pole is associated with separate said contacts and wherein said second housing accommodates two solenoids with associated plungers and spring means; with each of said separate contacts there is serially connected a separate one of said solenoids.

* * * * *